US011959342B2

(12) United States Patent
Hudson et al.

(10) Patent No.: US 11,959,342 B2
(45) **Date of Patent: *Apr. 16, 2024**

(54) ROPE TENSIONING SYSTEM FOR DRILLING RIG

(71) Applicant: Caterpillar Global Mining Equipment LLC, Denison, TX (US)

(72) Inventors: Charles T. Hudson, Sherman, TX (US); Elangovan Umapathy, Chennai (IN); Prasana R, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/735,452

(22) Filed: May 3, 2022

(65) Prior Publication Data

US 2023/0119591 A1 Apr. 20, 2023

Related U.S. Application Data

(60) Provisional application No. 63/256,320, filed on Oct. 15, 2021.

(51) Int. Cl.
*E21B 19/084* (2006.01)
*E21B 7/02* (2006.01)

(52) U.S. Cl.
CPC ..... *E21B 19/084* (2013.01); *E21B 7/022* (2013.01)

(58) Field of Classification Search
CPC ..... E21B 7/022; E21B 19/08; E21B 19/084; E21B 19/086
See application file for complete search history.

(56) References Cited

U.S. PATENT DOCUMENTS

| | | | | |
|---|---|---|---|---|
| 3,719,238 | A | 3/1973 | Campbell et al. | |
| 5,343,962 | A | 9/1994 | Daigle et al. | |
| 6,672,410 | B2 | 1/2004 | Smith | |
| 10,683,712 | B2 | 6/2020 | Demick et al. | |
| 2013/0175045 | A1* | 7/2013 | Rytlewski | F15B 1/02 60/327 |
| 2013/0343928 | A1* | 12/2013 | McCarthy | E21B 43/126 417/379 |
| 2019/0218902 | A1* | 7/2019 | Demick | E21B 19/084 |

* cited by examiner

*Primary Examiner* — Nathaniel C Chukwurah

(57) ABSTRACT

A hydraulic tensioning system is associated with a wire rope feed system of a drilling rig for applying tension to the hoist and pulldown ropes during hoist and pulldown operations. The hydraulic tensioning system includes a hydraulic tensioning circuit with a hoist hydraulic circuit directing hydraulic fluid to a hoist actuator applying tension to the hoist wire rope and a pulldown hydraulic circuit directing hydraulic fluid to a pulldown hydraulic actuator applying tension to a pulldown wire rope. A hydraulic control valve can selectively direct flow to the hoist and pulldown hydraulic circuits.

21 Claims, 5 Drawing Sheets

ROPE TENSIONING SYSTEM FOR DRILLING RIG

CROSS-REFERENCE TO RELATED APPLICATIONS

This patent application claims the benefit of U.S. Provisional Patent Application No. 63/256,320, filed Oct. 15, 2021, which is incorporated herein by reference.

TECHNICAL FIELD

This patent disclosure relates generally to drilling rigs for drilling a hole into the earth and, more particularly, to a wire rope system that can move a rotary head with respect to a mast of the drilling rig.

BACKGROUND

Drilling rigs are integrated systems used to drill holes into the ground of the earth. Drilling rigs are commonly used in the petroleum and gas industry, but may also be used for developing water wells, mineral excavation, and other uses. Drilling rigs typically include a mast that can be positioned vertically with respect to the surface of the ground to be drilled and a rotary head that can be vertically moved along the mast. The rotary head includes a driver that can rotate with respect to the rotary head body. The driver may be coupled to a drill string that is an elongated column or drill pipe of multiple string segments that are attached at the distal end to a drill bit. When the driver is rotated, it transmits torque through the drill string to the drill bit that cuts into the surface and subsurface of the earth.

To vertically move the rotary head with respect to the mast, the drilling rig includes a wire rope feed system formed of wire ropes that may be hydraulically actuated to pull down (move vertically downward) and hoist (move vertically upwards) the rotary head. In operation, the rotary head is pulled down over the length of the mast, decoupled from the drill string, and hoisted back up the length of the mast. Once hoisted, another string segment is coupled between the rotary head and the rest of the drill string. The rotary head is then pulled down again thereby feeding the drill string into the ground.

The wire ropes of the wire rope feed system may stretch and elongate during pulldown and hoist operations due to the forces applied. The stretching and elongation may be dynamic and occur during a particular pulldown or hoist operation and recover thereafter or may be permanent such that the overall length of the wire ropes after a duration of use may be greater than when the wire ropes were originally installed on the drilling rig. Because the wire rope feed system coordinates movement of the rotary head, stretching and elongation of the wire ropes may adversely affect operation of the drilling rig. To compensate for the slack created by the stretching and elongation of the wire ropes, the drilling rig may be equipped with a tensioning system that applies tension to the wire ropes. The present application is directed to such a hydraulic actuated tensioning system for a drilling rig.

SUMMARY OF THE DISCLOSURE

The disclosure provides a rotary drilling rig for drilling a hole into the earth. The drilling rig includes a rig frame and a mast mounted to the rig frame. A rotary head is movably supported along the mast and operatively coupled to and adapted to rotate a drilling string with respect to the work surface. To vertically move the rotary head with respect to the mast, the drilling rig includes a wire rope feed actuator and a wire rope feed system operatively connecting the rotary head with the wire rope feed actuator. The wire rope feed system includes a hoist wire rope operatively associated with a hoist tensioning actuator and connected at a hoist rope end to the rotary head and a pulldown wire rope operatively associated with a pulldown tensioning actuator and connected at a pulldown rope end to the rotary head. To direct hydraulic fluid to the hoist and pulldown tensioning actuators, the drilling rig also includes a hydraulic tensioning circuit. The hydraulic tensioning circuit can include a hydraulic control valve in fluid communication with and configured to selectively direct hydraulic fluid to the hydraulic tensioning circuit and to the wire rope feed actuator.

DETAILED DESCRIPTION

Figure 1:
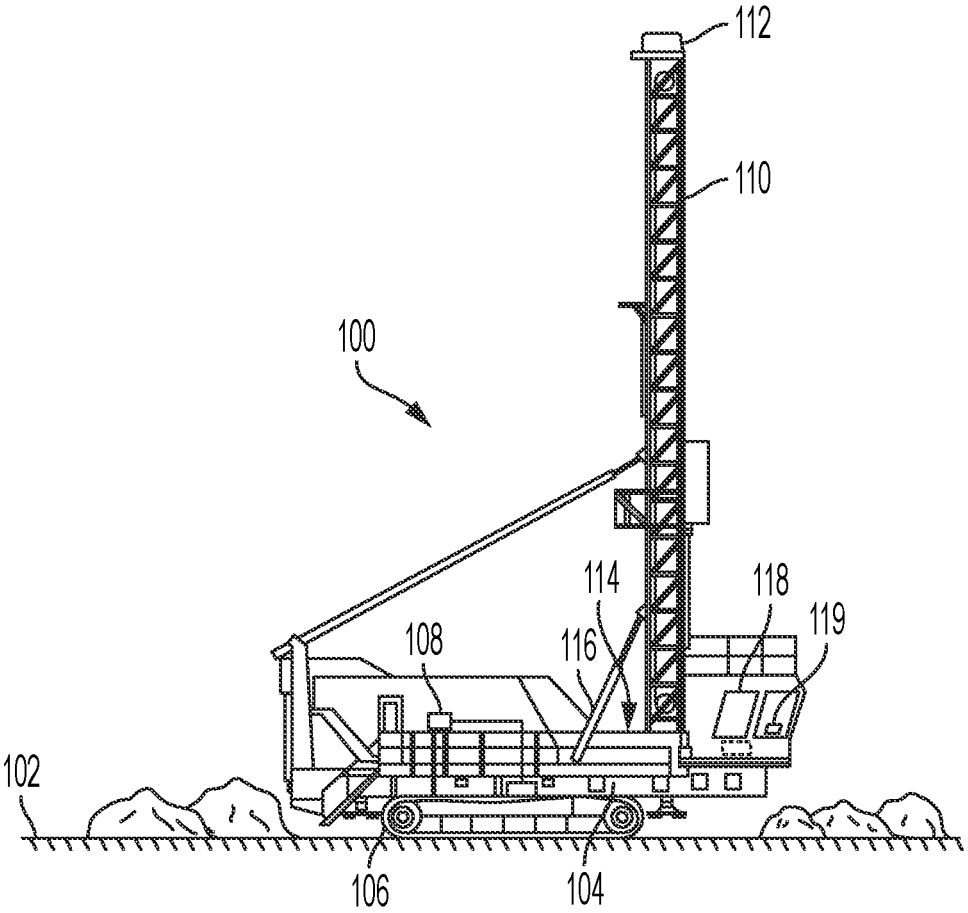
FIG. 1 is a schematic illustration of a mobile rotary drilling rig for forming a hole by feeding a drill string into the earth.

Now referring to the figures, wherein whenever possible like reference numbers refer to like elements, there is illustrated a mobile drilling rig 100 that can form holes into the work surface 102 and the underlying subsurface of the earth for oil and gas extraction, mineral procurement, well formation, and other uses. In the illustrated embodiment the drilling rig 100 is mobile and can move with respect to the work surface 102; however, the present disclosure is also applicable to fixed drilling rigs, offshore drilling rigs or platforms, and other configurations. The illustrated embodiment of the drilling rig 100 includes a rig frame 104 that is supported on a plurality of propulsion devices 106 that contact the work surface 102. The propulsion devices 106 may be continuous tracks or crawler tracks that can translate with respect to the rig frame 104 thereby moving the drilling rig over the work surface 102 or the propulsion devices may be rotating pneumatic wheels or, as stated above, the drilling rig may be stationary and fixed in location. To power the propulsion devices 106 and other systems of the drilling rig 100, a motor 108 is disposed on the rig frame 104. The motor 108 may be an internal combustion engine or an electrical motor that receives electric power from a remote source.

The drilling rig 100 can include a mast 110 that is an erect structure that can be vertically positioned with respect to the work surface 102. The mast 110 may extend between a top or crown 112 that is vertically elevated above the rig frame 104 and a base 114 that is located proximate to the work surface 102. The mast 110 can be assembled as a truss made from a plurality of metal beams and bars interconnected together to form a rigid structure capable of standing upright in the vertically elevated position. In an embodiment, the mast 110 can be pivotally coupled to the rig frame 104 so that the mast 110 can be raised and lowered between the vertical and non-vertical positions via a lift cylinder 116. When the mast 110 is in the raised position, the drilling rig 100 is configured for a drilling operation and when the mast is lowered, the drilling rig 100 is configured for a traveling operation.

To accommodate one or more human operators for conducting drilling operations, an onboard operator station 118 may be accommodated on the rig frame 104. Located within the operator station 118 can be various operator control devices 119 such as levers, pedals, wheels, displays, and the like. In the illustrated embodiment, the operator station 118 can be an enclosed space but, in other embodiments, the operator station 118 may be located exteriorly. Furthermore, in possible embodiments, the drilling rig 100 can be configured for remote operation with the operator station 118 and the operator control devices 119 located off board of and remote from the drilling rig 100.

Figure 2:
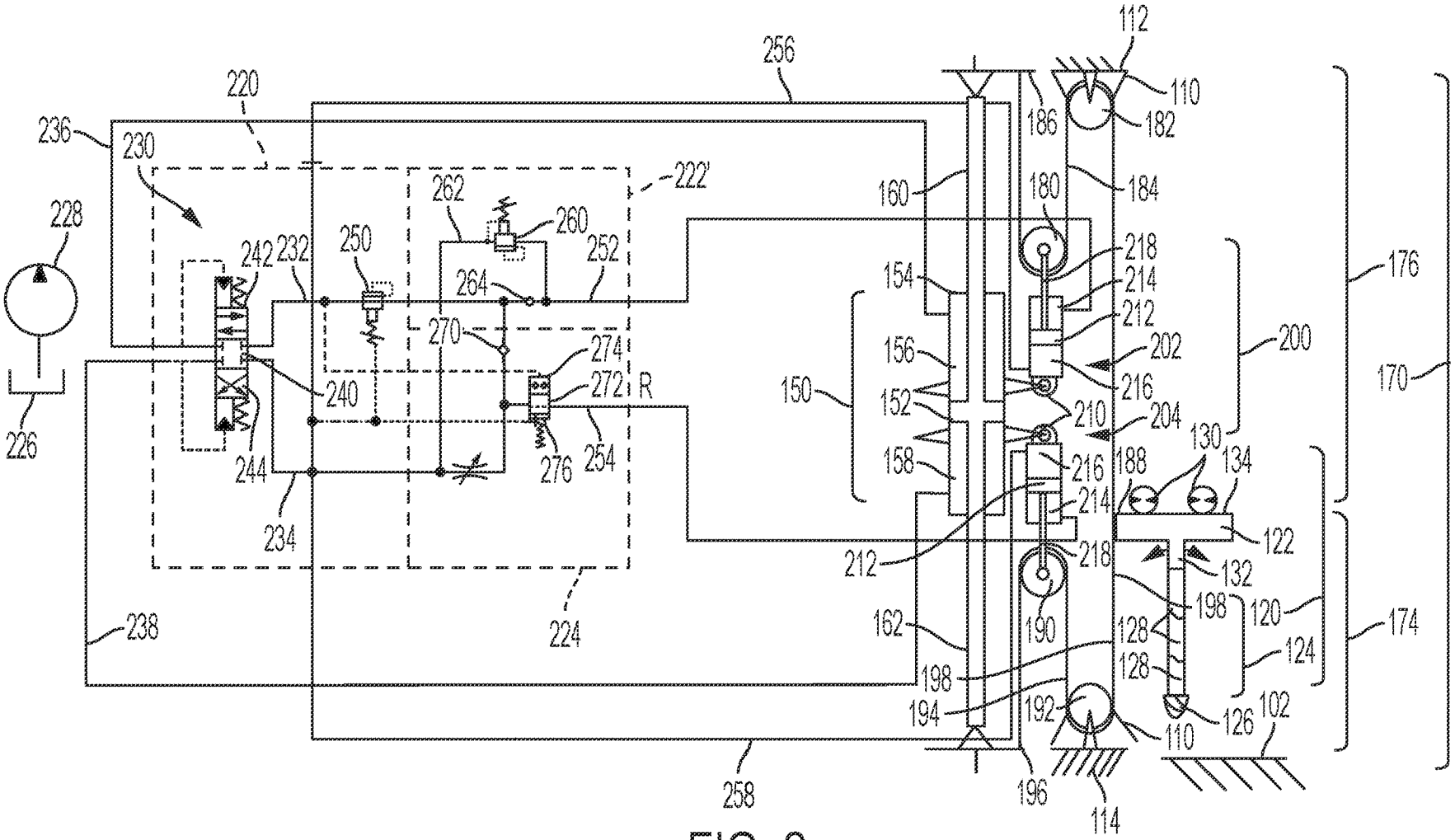
FIG. 2 is a schematic illustration of an embodiment of the wire rope feed system of a drilling rig for vertically moving a rotary head with respect to a mast of the drilling rig, the wire rope feed system operatively associated with a hydraulic tensioning circuit to maintain tension on the hoist and/or pulldown wire ropes of the wire rope feed system.

Referring to FIG. 2, there is illustrated an embodiment of the drilling system 120 of the drilling rig 100. The drilling system 120 may include a rotary head 122 that is guided by and vertically movable along the mast 110 with respect to the work surface 102. The rotary head 122 can be operatively coupled to an elongated drill string 124 at the distal end of which may be a drill bit 126 for boring into the work surface 102 and the subsurface underneath. The drill string 124 can be assembled from a plurality of string sections 128 that can be coupled together to adjust the length of the drill string 124. To rotate the drill string 124, the rotary head 122 can include one or more hydraulic motors 130 that can be operatively associated with a hydraulic system of the drilling rig. The hydraulic motors 130 can receive pressurized hydraulic fluid from the hydraulic system and can convert the fluid pressure into mechanical rotational motion or torque to rotate a driver 132 disposed in the body 134 of the rotary head 122 and coupled to the drill string 124, thereby rotating the drill string 124 with respect to both the rotary head 122 and the work surface 102.

To move the rotary head 122 with respect to the mast 110, the drilling system 120 includes a wire rope feed actuator 150 that includes a disc-shaped feed actuator piston 152 disposed within a tubular feed actuator cylinder 154. The feed actuator piston 152 can separate the feed actuator cylinder 154 into an upper chamber 156 and a lower chamber 158. The wire rope feed actuator 150 can be fluidly coupled to the hydraulic system of the drilling rig 100 to receive pressurized hydraulic fluid to either the upper chamber 156 or the lower chamber 158 of the feed actuator cylinder 154. The feed actuator piston 152 can be fixedly connected with the mast 110 so that when hydraulic fluid is introduced, for example, into the upper chamber 156, the feed actuator cylinder 154 is forcibly moved upwards with respect to the mast 110. Similarly, when hydraulic fluid is introduced into the lower chamber 158, the feed actuator cylinder 154 is forcibly move downwards with respect to the mast 110.

In the illustrated embodiment, to fix the feed actuator piston 152 to the mast 110 and enable vertical motion of the feed actuator cylinder 154, the wire rope feed actuator 150 can include a first feed actuator piston rod 160 joined to the feed actuator piston 152 that extends axially upwards through the upper chamber 156 of the hollow feed actuator cylinder 154 and can be fixedly connected proximate to the crown 112 of the mast 110. Likewise, a second feed actuator piston rod 162 joined to the feed actuator piston 152 can extend axially downwards through the lower chamber 158 of the hollow feed actuator cylinder 154 and can be fixedly connected proximate to the base 114 of the mast 110. Accordingly, the relative vertical position of the feed actuator piston 152 with respect to the mast 110 is rigidly fixed. The feed actuator cylinder 154 therefore acts as a free body such that introduction of hydraulic fluid into either the upper chamber 156 or the lower chamber 158 of the wire rope feed actuator 150 results in vertical movement of the feed actuator cylinder 154 generally between the mast crown 112 and the mast base 114. In another embodiment, the feed actuator cylinder 154 may be fixed with respect to the mast 110 and the feed actuator piston 152 and the first and second feed actuator piston rods 160, 162 may move with respect to the mast.

To translate vertical movement of the wire rope feed actuator 150 with respect to the mast 110 to relative movement of the rotary head 122, the drilling system 120 can include or be operatively associated with a wire rope feed system 170 including a plurality of wire ropes that can operatively connect the wire rope feed actuator 150 to the body 134 of the rotary head 122. The wire ropes can be formed as steel wire ropes assembled from many individual strands of thinner metal wires wound or braided together to form a flexible, elongated, and larger diameter wire rope. The flexible steel wire rope can be used as the running rigging of the wire rope feed system 170 and are adapted to bend around and extend about sheaves and pulleys. Depending on the drilling operation, the wire rope feed system 170 can be further differentiated into a hoist rope system 172 responsible for hoisting the rotary head 122 and a pulldown rope system 174 responsible for pulling down the rotary head 122 with respect to the work surface 102. It should be appreciated however that the hoist rope system 172 and the pulldown rope system 174 operate in cooperation to perform their respective operations.

The hoist rope system 172 can encompass the upper components of the wire rope feed system 170 and can include a feed actuator hoist pulley 180 that may fixedly mounted to and movable with the feed actuator cylinder 154 such that the feed actuator hoist pulley 180 can vertically move in unison with the feed actuator cylinder 154. The hoist rope system 172 can also include a mast hoist pulley 182 fixedly mounted to the crown 112 of the mast 110 and is thus suspended vertically high above the work surface 102. Directed around and operatively linking the feed actuator hoist pulley 180 and the mast hoist pulley 182 can be a fixed length of flexible hoist wire rope 184. The hoist wire rope 184 can extend between a first hoist rope end 186 proximately connected with the crown 112 of the mast 110 and a second hoist rope end 188 fixedly connected to the exterior upper end of the body 134 of the rotary head 122. To enable the hoist wire rope 184 to run between and extend around the feed actuator hoist pulley 180 and the mast hoist pulley 182, those components can each include a rotating sheave supported by a pulley frame and which is formed as a grooved wheel that contains and guides the hoist wire rope.

The pulldown rope system 174 can encompass the lower components of the wire rope feed system 170 and can include a feed actuator pulldown pulley 190 that may be fixedly mounted to and moveable with the feed actuator cylinder 154 such that the feed actuator pulldown pulley 190 can vertically move in unison with the feed actuator cylinder 154. The pulldown rope system 174 can also include a mast pulldown pulley 192 fixedly mounted to the base 114 of the mast 110 and is thus generally located proximate to the work surface 102. Directed around and operatively linking the feed actuator pulldown pulley 190 and the mast pulldown pulley 192 can be a fixed length of flexible pulldown wire rope 194. The pulldown wire rope 194 can extend between a first pulldown rope end 196 proximately connected with the base 114 of the mast 110 and a second pulldown rope end 198 fixedly connected to the exterior lower end of the body 134 of the rotary head 122. To enable the pulldown wire rope 194 to run between and extend around the feed actuator pulldown pulley 190 and the mast pulldown pulley 192, those components can each include a rotating sheave supported by a pulley frame and which is formed as a grooved wheel that contains and guides the pulldown wire rope.

The pulleys and wire rope of the hoist rope system 172 and the pulleys and wire rope of the pulldown rope system 174 form block and tackle systems for vertically hoisting and pulling down the rotary head 122. For example, during a hoist operation, pressurized hydraulic fluid is directed into the lower chamber 158 of the wire rope feed actuator 150, causing the feed actuator cylinder 154 acting as a free body to move vertically downwards with respect to the mast 110. This may be referred to as fluidly actuating the lower chamber 158 of the wire rope feed actuator 150 because the hydraulic fluid directed thereto displaces the feed actuator cylinder 154 downwards. The feed actuator hoist pulley 180 likewise moves vertically downwards with the feed actuator cylinder 154 and thus moves vertically apart from the mast hoist pulley 182. To accommodate the increasing vertical distance between the feed actuator hoist pulley 180 and mast hoist pulley 182, and likewise the increasing vertical distance between the feed actuator hoist pulley 180 and the crown 112 of the mast 110, the length of the hoist wire rope 184 between those elements must be increased. Because the hoist wire rope 184 has a fixed length between the first hoist rope end 186 connected to the mast crown 112 and the second hoist rope end 188 connected to the body 134 of the rotary head 122, the increase in the length of the hoist wire rope 184 between the feed actuator hoist pulley 180 and mast hoist pulley 182 is accompanied by a corresponding decrease in length of the hoist wire rope 184 between the mast hoist pulley 182 and the rotary head 122. The result is that the rotary head 122 is pulled vertically upwards with respect to the mast 110 and towards the crown 112. It will be appreciated that pulldown rope system 174 must function in an opposite manner to increase the length of the pulldown wire rope 194 extending between the mast pulldown pulley 192 and the body 134 of the rotary head 122 to allow the rotary head to vertically rise with respect to the mast 110.

Correspondingly, during a pulldown operation, pressurized hydraulic fluid is directed into the upper chamber 156 of the wire rope feed actuator 150, causing the feed actuator cylinder 154 acting as free body to move vertically upwards with respect to the mast 110. This may be referred to as fluidly actuating the upper chamber 156 of the wire rope feed actuator 150 because the hydraulic fluid directed thereto vertically moves the feed actuator cylinder 154 vertically upwards. The feed actuator pulldown pulley 190 likewise moves vertically upwards with the feed actuator cylinder 154 and thus moves vertically apart from the mast pulldown pulley 192. To accommodate the increasing vertical distance between the feed actuator pulldown pulley 190 and mast pulldown pulley 192, and likewise the increasing vertical distance between the feed actuator pulldown pulley 190 and base 114 of the mast 110, the length of the pulldown wire rope 194 between those elements must be increased. Because of the fixed length of the pulldown wire rope 194, the increase in the length of the pulldown wire rope 194 between the feed actuator pulldown pulley 190 and mast pulldown pulley 192 is accompanied by a corresponding decrease in length of the pulldown wire rope between the mast pulldown pulley 192 and the rotary head 122. This results in the rotary head 122 being pulled downwards with respect to the mast 110 and towards the base 114. Downward movement of the rotary head 122 drives the drill string 124 and drill bit 126 into the work surface 102. It will be appreciated that the hoist rope system 172 must cooperatively function in an opposite manner to increase the length of the hoist wire rope 184 extending between the mast hoist pulley 182 and the body 134 of the rotary head 122 to allow the rotary head to move vertically downwards.

The hoist wire rope 184 and the pulldown wire rope 194 are placed under significant stress and tension during the respective hoist and pulldown operations. The tension can stretch and cause elongation of the hoist wire rope 184 and pulldown wire rope 194 and, because of the substantial lengths of the hoist and pulldown wire ropes, elongation of the wire ropes may be approximately several millimeters or inches. Maintaining the hoist wire rope 184 and the pulldown wire rope 194 in tension may compensate for elongation of the wire rope. However, if tension on the hoist wire rope 184 or the pulldown wire rope 194 is suddenly released, for example, when switching between hoist and pulldown operations or if the drilling system 120 were to encounter a hard rock formation during a pulldown operation, the wire ropes may become slack as result of the previous stretching and elongation. Slack in the hoist wire rope 184 and the pulldown wire rope 194 may allow the wire ropes to dislodge or come off of the pulleys and the freed wire ropes may swing about and cause damage to the surrounding components of the drilling system 120. Moreover, because the fixed lengths of the hoist and pulldown wire ropes coordinate much of the operation of the drilling system 120 including vertical movement of the rotary head 122 with respect to the mast 110, slack and elongation may adversely affect operation of the drilling rig.

Therefore, to maintain tension on the hoist wire rope 184 and the pulldown wire rope 194, the drilling system 120 may be associated with a hydraulic tensioning system 200 including a hoist tensioning actuator 202 and pulldown tensioning actuator 204. The hoist and pulldown tensioning actuators 202, 204 may be embodied as double acting cylinders or, in an embodiment, as spring-loaded, single acting cylinders responsive to the receipt and discharge of hydraulic fluid therein. The hoist and pulldown tensioning actuators 202, 204 may include a hollow, tubular hydraulic cylinder body 210 with a disc-like hydraulic piston 212 disposed therein. The hydraulic piston 212 can separate the hydraulic cylinder body 210 into a first hydraulic chamber, referred to as the rod end chamber 214, and a second hydraulic chamber, referred to as the piston end chamber 216. The hoist and pulldown tensioning actuators 202, 204 can include a hydraulic piston rod 218 that is connected to the hydraulic piston 212 and extends through the rod end chamber 214 to protrude from the hydraulic cylinder body 210. Moving the hydraulic piston 212 toward the rod end chamber 214 extends the hydraulic piston rod 218 from the hydraulic cylinder body 210 and moving the hydraulic piston 212 toward the piston end chamber 216 retracts the hydraulic piston rod 218 into the hydraulic cylinder body 210.

In the illustrated embodiment, the hoist and pulldown tensioning actuators 202, 204 can be fixedly mounted to and movable with the feed actuator cylinder 154 of the wire rope feed actuator 150. For example, the hoist tensioning actuator 202 may be associated in location with the upper chamber 156 of the feed actuator cylinder 154 and oriented so that the hydraulic piston rod 218 is directed vertically upwards toward the crown 112 of the mast 110. Likewise, the pulldown tensioning actuator 204 may be associated in location with the lower chamber 158 of the feed actuator cylinder 154 and oriented so that the hydraulic piston rod 218 is directed vertically downwards toward the base 114 of the mast 110. In other embodiments, the hoist and pulldown tensioning actuators 202, 204 may be disposed in other locations and with different orientations, for example, the hoist tensioning actuator 202 may be fixedly disposed on the crown 112 and the pulldown tensioning actuator 204 may be fixedly disposed on the base 114.

To interact with and apply tension to the hoist wire rope 184, the distal end of the hydraulic piston rod 218 of the hoist tensioning actuator 202 can be connected to the feed actuator hoist pulley 180 thereby connecting the feed actuator hoist pulley 180 with the feed actuator cylinder 154. The feed actuator hoist pulley 180, which the hoist wire rope 184 extends about, can extend and retract with the hydraulic piston rod 218 of the hoist tensioning actuator 202. Likewise, the distal end of the hydraulic piston rod 218 of the pulldown tensioning actuator 204 can be connected to the feed actuator pulldown pulley 190 thereby connecting the feed actuator hoist pulley 180 with the feed actuator cylinder 154. The feed actuator pulldown pulley 190, which the pulldown wire rope 194 extends about, can thus extend and retract with the hydraulic piston rod 218 of the pulldown tensioning actuator 204.

To selectively direct hydraulic fluid to and from the hoist tensioning actuator 202 and the pulldown tensioning actuator 204 and thereby actuate movement of the feed actuator hoist pulley 180 and feed actuator pulldown pulley 190, the wire rope feed system 170 can be operatively associated with a hydraulic tensioning circuit 220. The hydraulic tensioning circuit 220 can be separated into a hoist tensioning circuit 222 operatively associated with the hoist tensioning actuator 202 and a pulldown tensioning circuit 224 operatively associated with the pulldown tensioning actuator 204. To accommodate and channel hydraulic fluid for the hoist and pulldown tensioning circuits 222, 224, the hydraulic tensioning circuit 220 can be in fluid communication with a hydraulic reservoir 226 or tank and with a hydraulic pump 228 that can pressurize and direct the hydraulic fluid through various fluid conduits that may be, for example, flexible hoses or rigid tubular pipes. In an embodiment, the hydraulic reservoir 226 and the hydraulic pump 228 may also be responsible for directing hydraulic fluid to the wire rope feed actuator 150 causing the feed actuator cylinder 154 to move vertically with respect to the mast 110 during hoist or pulldown operations.

To selectively establish fluid communication between the hydraulic reservoir 226 and hydraulic pump 228 and the hoist and pulldown tensioning actuators 202, 204 associated with the hydraulic tensioning circuit 220, a hydraulic control valve 230 can be disposed in the circuit. To fluidly communicate with the hoist and pulldown tensioning actuators 202, 204, the hydraulic control valve 230 can be fluidly coupled to a tensioning actuator supply conduit 232 arranged to direct hydraulic fluid from the hydraulic pump 228 to the tensioning actuators. Likewise, in an embodiment, the hydraulic control valve 230 can be fluidly coupled to a tensioning actuator return conduit 234 arranged to direct hydraulic fluid from the tensioning actuators to the hydraulic reservoir 226. In addition, in an embodiment, the hydraulic control valve 230 can be operatively associated with and in fluid communication with the wire rope feed actuator 150 via an upper chamber conduit 236 fluidly connected with the upper chamber 156 of the feed actuator cylinder 154 and via a lower chamber conduit 238 fluidly connected to the lower chamber 158 of the feed actuator cylinder 154. The hydraulic control valve 230 can regulate and direct hydraulic fluid flow to and from the hoist and pulldown tensioning actuators 202, 204 in response to the pulldown and hoist operations of the wire rope feed actuator 150 by responding to flow of pressurized hydraulic fluid in the upper chamber conduit 236 and the lower chamber conduit 238.

In an embodiment, the hydraulic control valve 230 can be configured as a three-position, four-way valve with a plurality of positions that selectively direct fluid flow through the valve. The different positions, which may be defined by internal valve passages fluidly coupled to fluid conduits connected to the hydraulic control valve 230, can be selectively shifted into and out of active operation. The hydraulic control valve 230 can be actuated mechanically, electrically, or hydraulically.

In an embodiment, the hydraulic control valve 230 can include a closed center position 240 that prevents fluid flow between the hydraulic tensioning circuit 220 and the hydraulic reservoir 226 and hydraulic pump 228. When in the closed center position 240, the hydraulic control valve 230 operatively deactivates the hydraulic tensioning circuit 220 and the hydraulic fluid cannot flow to or from the hoist and pulldown tensioning actuators 202, 204. The hydraulic control valve 230 can also include a first position 242 and a second position 244. When in the first or second positions, the hydraulic control valve 230 can selectively direct hydraulic fluid to the hoist tensioning circuit 222 and the pulldown tensioning circuit 224, and thus onto the hoist tensioning actuator 202 and the pulldown tensioning actuator circuit 204 respectively associated therewith.

During hoist and pulldown operations, pressurized hydraulic fluid to be directed to one of the upper chamber 156 or lower chamber 158 of the feed actuator cylinder 154 while the other of the upper chamber 156 or lower chamber 158 may be exposed to low pressure, for example, by established fluid communication between the upper or lower chamber 156, 158 and the tensioning actuator return conduit 234 that communicates with the hydraulic reservoir 226. The wire rope feed actuator 150 can be configured in a hoist or pulldown operation depending upon which of the upper chamber 156 or lower chamber 158 receives the pressurized hydraulic fluid and which of the upper chamber 156 and the lower chamber 158 is fluidly connected with the tensioning actuator return conduit 234.

Because the pressure of hydraulic fluid directed to the hydraulic tensioning circuit 220 may be in excess or higher than the pressure which the hoist and pulldown tensioning actuators 202, 204 are intended to operate at, the hydraulic tensioning circuit 220 can include a pressure reducing valve 250 disposed downstream of the hydraulic control valve 230 to control or reduce the pressure of the inflowing fluid. The pressure reducing valve 250 can be a spring biased valve that is normally opened but can throttle or reduce flow there through to lower the pressure of the hydraulic fluid from the hydraulic pump 228. In various embodiments, the pressure reducing valve 250 may be actuated mechanically, electrically or hydraulically. The hydraulic pressure established by the pressure reducing valve 250 can be referred to as the tensioning pressure of the hydraulic tensioning circuit 220.

To direct inflowing pressurized hydraulic fluid at the tensioning pressure onto the hoist tensioning actuator 202 or the pulldown tensioning actuator 204, the tensioning actuator supply conduit 232 can be differentiated downstream of the pressure reducing valve 250 into a hoist actuator supply conduit 252 associated with the hoist tensioning circuit 222 and a pulldown actuator supply conduit 254 associated with the pulldown tensioning circuit 224. The hoist actuator supply conduit 252 can be fluidly connected to the rod end chamber 214 of the hoist tensioning actuator 202 fixedly mounted to the feed actuator cylinder 154 of the wire rope feed actuator 150. When pressurized hydraulic fluid is introduced to the rod end chamber 214, the fluid will displace the hydraulic piston 212 to the piston end chamber 216 thereby retracting the hydraulic piston rod 218 into the hydraulic cylinder body 210. Retracting the hydraulic piston rod 218 further retracts the feed actuator hoist pulley 180 connected thereto and applies tension to the hoist wire rope 184 and reduces any slack that may occur in the hoist wire rope 184. Similarly, the pulldown actuator supply conduit 254 can be fluidly connected to the rod end chamber 214 of the pulldown tensioning actuator 204. Flow of pressurized hydraulic fluid to the rod end chamber 214 displaces the hydraulic piston 212 toward the piston end chamber 216 retracting the hydraulic piston rod 218 and the feed actuator pulldown pulley 190 connected thereto with respect to the hydraulic cylinder body 210. The pulldown tensioning actuator 204 therefore applies tension to the pulldown wire rope 194 removing slack therein.

In an embodiment, to facilitate retraction of the hydraulic piston rod 218 into the hydraulic cylinder body 210 of the hoist and pulldown tensioning actuators 202, 204, the piston end chamber 216 can be in fluid communication with a hoist actuator return conduit 256 and a pulldown actuator return conduit 258 respectively. In this embodiment, the hoist actuator return conduit 256 and the pulldown actuator return conduit 258 can be fluidly coupled to the hydraulic reservoir 226 to discharge hydraulic fluid thereto. In other embodiments, the piston end chambers 216 may not receive or accommodate hydraulic fluid and the hoist and pulldown tensioning actuators 202, 204 may be spring-loaded, single acting cylinders.

During a pulldown operation, the feed actuator cylinder 154 and the pulldown tensioning actuator 204 attached thereto are moved vertically upwards while the rotary head 122 is correspondingly moved downwards thereby forcing the drill string 124 into the work surface 102. Due to forcibly driving the rotary head 122 toward work surface 102, significant stresses and forces are applied to the pulldown wire rope 194 that may cause the pulldown wire rope 194 to stretch and elongate. However, in an opposite reaction, slack may develop in the hoist wire rope 184 that is fed through the block and tackle system configured by the feed actuator hoist pulley 180 and mast hoist pulley 182 to follow the vertically downward movement of the rotary head 122. Because the rod end chamber 214 of the hoist tensioning actuator 202 is in direct fluid communication with the pressure reducing valve 250, it receives hydraulic fluid at and is maintained at the tensioning pressure established by the pressure reducing valve 250. Accordingly, during a pulldown operation with the hoist tensioning actuator 202 maintained at the tensioning pressure, thereby retracting the hydraulic piston rod 218 and the feed actuator hoist pulley 180 connected thereto, a corresponding tensioning force is applied to the hoist wire rope 184 and slack that may otherwise occur is reduced.

If the drilling system 120 is switched between to a pulldown operation and a hoist operation, however, the forces applied to the hoist and pulldown wire ropes 184, 194 may change significantly. For example, the hydraulic pressure in the rod end chamber 214 of the hoist tensioning actuator 202, and thus the stresses therefore applied to the hoist wire rope 184, may increase beyond the stresses associated with the tensioning pressure established by the pressure reducing valve 250. Maintaining significant or excess stress on the hoist wire rope 184 can adversely impact the life of the wire rope and require premature replacement.

To prevent the hydraulic pressure in the hoist tensioning actuator 202 and thus the tensioning forces applied to the hoist wire rope 184 from becoming excessive, the hoist tensioning circuit 222 can include a pressure relief valve 260. The pressure relief valve 260 can be in fluid communication with the rod end chamber 214 of the hoist tensioning actuator 202 and may be located in bypass conduit 262 that is fluidly coupled to and extends between the hoist actuator supply conduit 252 and the hoist actuator return conduit 256. The pressure relief valve 260 can be in a normally closed state thereby closing the bypass conduit 262 so that hydraulic fluid entering the hoist tensioning circuit 222 from the pressure reducing valve 250 is directed to the rod end chamber 214 of the hoist tensioning actuator 202.

In the event the hydraulic pressure in the rod end chamber 214 exceeds a predetermined hydraulic pressure, referred to herein as the relief pressure threshold, the pressure relief valve 260 can partially open allowing a portion of the hydraulic fluid in the hoist tensioning circuit 222 to flow directly to the hoist actuator return conduit 256 and onto the hydraulic reservoir 226 thereby bypassing the hoist tensioning actuator 202. The pressure relief valve 260 thus maintains or limits the rod end chamber 214 of the hoist tensioning actuator 202 at the relief pressure threshold and the tension applied to the hoist wire rope 184 is maintained in accordance with the relief pressure threshold. In an embodiment, the relief pressure threshold at which the pressure relief valve 260 opens may be factor or multiple of the tensioning pressure set by the pressure reducing valve 250 which is located fluidly upstream of the pressure relief valve 260 and the bypass conduit 262. For example, if the tensioning pressure established by the pressure reducing valve 250 is 10 bars, the relief pressure threshold can be a factor of between 3 and 6 times of the tensioning pressure.

To ensure that hydraulic fluid is directed to the pressure relief valve 260 in the event the hydraulic pressure in the hoist tensioning actuator 202 exceeds the tensioning pressure established by the pressure reducing valve 250, in an embodiment, a hoist circuit check valve 264 can be located in the hoist actuator supply conduit 252. The hoist circuit check valve 264 can be a one-way flow control valve that allows inflowing hydraulic fluid to flow into the hoist tensioning actuator 202 but prevents hydraulic fluid from flowing back upstream towards the pressure reducing valve 250. The hoist circuit check valve 264 maintains or limits hydraulic pressure downstream in the hoist actuator supply conduit 252 and in the hoist tensioning actuator 202 at the relief pressure threshold. If the hydraulic pressure in the hoist tensioning actuator 202 exceeds the inflowing pressure, for example, the tensioning pressure established by the pressure reducing valve 250, the hydraulic fluid is trapped in the hoist tensioning circuit 222 by the hoist circuit check valve 264 until the relief pressure threshold is exceeded and the pressure relief valve 260 in the bypass conduit 262 opens diverting fluid flow to the hydraulic reservoir 226.

The pulldown actuator supply conduit 254 of the pulldown tensioning circuit 224 can be fluidly connected with the hoist actuator supply conduit 252 downstream of the pressure reducing valve 250 and can be fluidly connected to the rod end chamber 214 of the pulldown tensioning actuator 204. The pulldown actuator supply conduit 254 thereby directs hydraulic fluid at the tensioning pressure from the pressure reducing valve 250 to the rod end chamber 214 of the pulldown tensioning actuator 204 establishing at least the tensioning pressure therein. The tensioning pressure will tend to retract the hydraulic piston rod 218 and the feed actuator pulldown pulley 190 connected thereto with respect to the hydraulic cylinder body 210. Accordingly, during a hoisting operation, for example, the pulldown tensioning actuator 204 can maintain the pulldown wire rope 194 under tension in accordance with the tensioning pressure set by the pressure reducing valve 250.

In an embodiment, the pulldown tensioning circuit 224 can include a pressure isolation feature that is configured to isolate the hydraulic pressure established in the pulldown tensioning actuator 204. More specifically, the pressure isolation feature may function to isolate or trap hydraulic fluid in the rod end chamber 214 of the pulldown tensioning actuator 204 and thus maintains the hydraulic pressure established therein, even if above the tensioning pressure established by the pressure reducing valve 250. In an embodiment, the pressure isolation feature may be a pulldown circuit check valve 270 disposed in the pulldown actuator supply conduit 254 and located between the fluid connection to the hoist actuator supply conduit 252 and the pulldown tensioning actuator 204. The pulldown circuit check valve 270 can be a one-way flow valve that allows inflowing hydraulic fluid to flow into the pulldown tensioning actuator 204 but prevents hydraulic fluid from flowing back upstream toward the pressure reducing valve 250.

The pulldown circuit check valve 270 ensures the pulldown tensioning actuator 204 is maintained at least at the predetermined pressure set by the pressure reducing valve 250, for example, the tensioning pressure. For example, if the rod end chamber 214 of the pulldown tensioning actuator 204 were to fall below the tensioning pressure, the pulldown circuit check valve 270 would open to direct inflowing hydraulic fluid to the rod end chamber 214 and return the hydraulic pressure therein to the tensioning pressure. If the hydraulic pressure in the rod end chamber 214 were to exceed the tensioning pressure established by the inflowing hydraulic fluid, the pulldown circuit check valve 270 would prevent hydraulic fluid flowing back upstream towards the hoist actuator supply conduit 252 and pressure reducing valve 250 and maintains the rod end chamber 214 of the pulldown tensioning actuator 204 at the elevated hydraulic pressure.

Because the pulldown circuit check valve 270 is capable of isolating and trapping pressurized hydraulic fluid in the rod end chamber 214 of the pulldown tensioning actuator 204, the pulldown tensioning circuit 224 can include a feature to limit and prevent the hydraulic pressure in the pulldown tensioning actuator from becoming excessive. For example, during a hoisting operation, substantial tensioning pressures may be applied to the hoist wire rope 184 due to the vertically downward motion of the feed actuator cylinder 154 that result in stretching or elongation of the hoist wire rope 184. The pulldown wire rope 194 may undergo an opposite action and begin to slacken. Accordingly, the pulldown tensioning circuit 224 will direct hydraulic fluid at the tensioning pressure from the pressure reducing valve 250 through the pulldown circuit check valve 270 in the pulldown actuator supply conduit 254 to the rod end chamber 214 of the pulldown tensioning actuator 204 to maintain the pulldown wire rope 194 in tension and reduce any slack therein.

However, when the hoisting operation ceases, there may be an excess amount of hydraulic fluid in the pulldown tensioning actuator 204 that may cause excessive pressures in the pulldown tensioning actuator when the pulldown wire rope 194 is placed under significant tension stresses again, for example, by initiating and undergoing an pulldown operation. To limit flow of hydraulic fluid to the pulldown tensioning actuator 204 during such circumstances, the pulldown tensioning circuit 224 can include a pulldown control valve 272 disposed in the pulldown actuator supply conduit 254. The pulldown control valve 272 may be configured as a two-position, two way valve including an opened position 274 establishing fluid communication between the rod end chamber 214 of the pulldown tensioning actuator 204 and the pulldown actuator supply conduit 252 and the closed position 276 preventing the flow of hydraulic fluid to the rod end chamber 214 of the pulldown tensioning actuator 204.

The pulldown control valve 272 may configure itself in the closed position 276 if the hydraulic pressure in the wire rope feed actuator 150 exceeds a predetermined hoisting pressure limit. The hoisting pressure limit associated with the wire rope feed actuator 150 may be set to prevent the flow of hydraulic fluid to the pulldown tensioning actuator 204 based on the hydraulic pressure in the wire rope feed actuator 150 during hoisting operations. Because the hydraulic pressure in the pulldown tensioning actuator 204 is limited under these circumstances, the pulldown tensioning actuator 204 will not apply or result in an excessive pulldown rope tension when the hoisting operation ceases.

Figure 3:
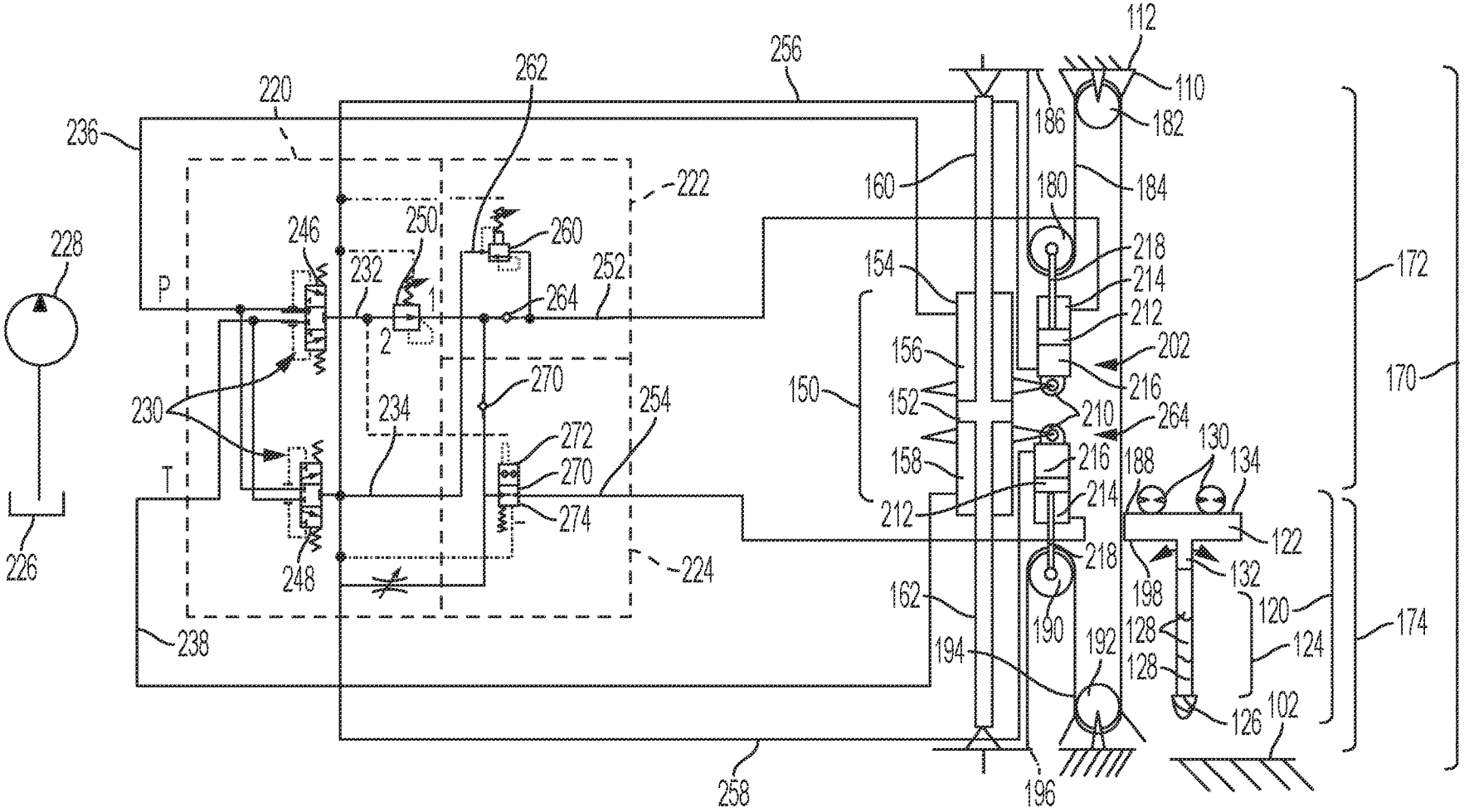
FIG. 3 is a schematic illustration of the wire rope feed system operatively associated with another embodiment of the hydraulic tensioning circuit to maintain tension on the hoist and/or pulldown wire ropes of the wire rope feed system.

Referring to FIG. 3, there is illustrated another embodiment of the hydraulic tensioning circuit 220 configured to selectively regulate the flow of hydraulic fluid between the hoist tensioning circuit 222, the pulldown tensioning circuit 224, and the wire rope feed actuator 150. The components and arrangement of the drilling system 120, wire rope feed system 170, the hoist tensioning circuit 222, and the pulldown tensioning circuit 224 are substantially the same as shown and described in FIG. 2.

The hydraulic control valve 230 however may include a first valve 246 and a second valve 248. The first valve 246 may be fluidly associated with the tensioning actuator supply conduit 232 and configured to direct hydraulic fluid to the hoist and pulldown tensioning actuators 202, 204. The second valve 248 may be fluidly associated with the tensioning actuator return conduit 234 and configured to direct hydraulic fluid from the hoist and pulldown tensioning actuators 202, 204 to a hydraulic reservoir 226. The first and second valves 246, 248 may also be in fluid communication with the wire rope feed actuator 150. For example, the first and second valves can selectively establish fluid communication between either the upper chamber 156 and the lower chamber 158 of the wire rope feed actuator 150 and the tensioning actuator return conduit 234 to place the upper or lower chamber at a relatively low hydraulic fluid pressure during hoist or pulldown operations. The first and second valves 246, 248 of the hydraulic control valve 230 can facilitate operation of the wire rope feed actuator 150 and the wire rope feed system 170 associated there with. In an embodiment, the first and second valve 246, 248 can be configured as three-position, two way valves and can be actuated mechanically, hydraulically, or electrically.

Figure 4:
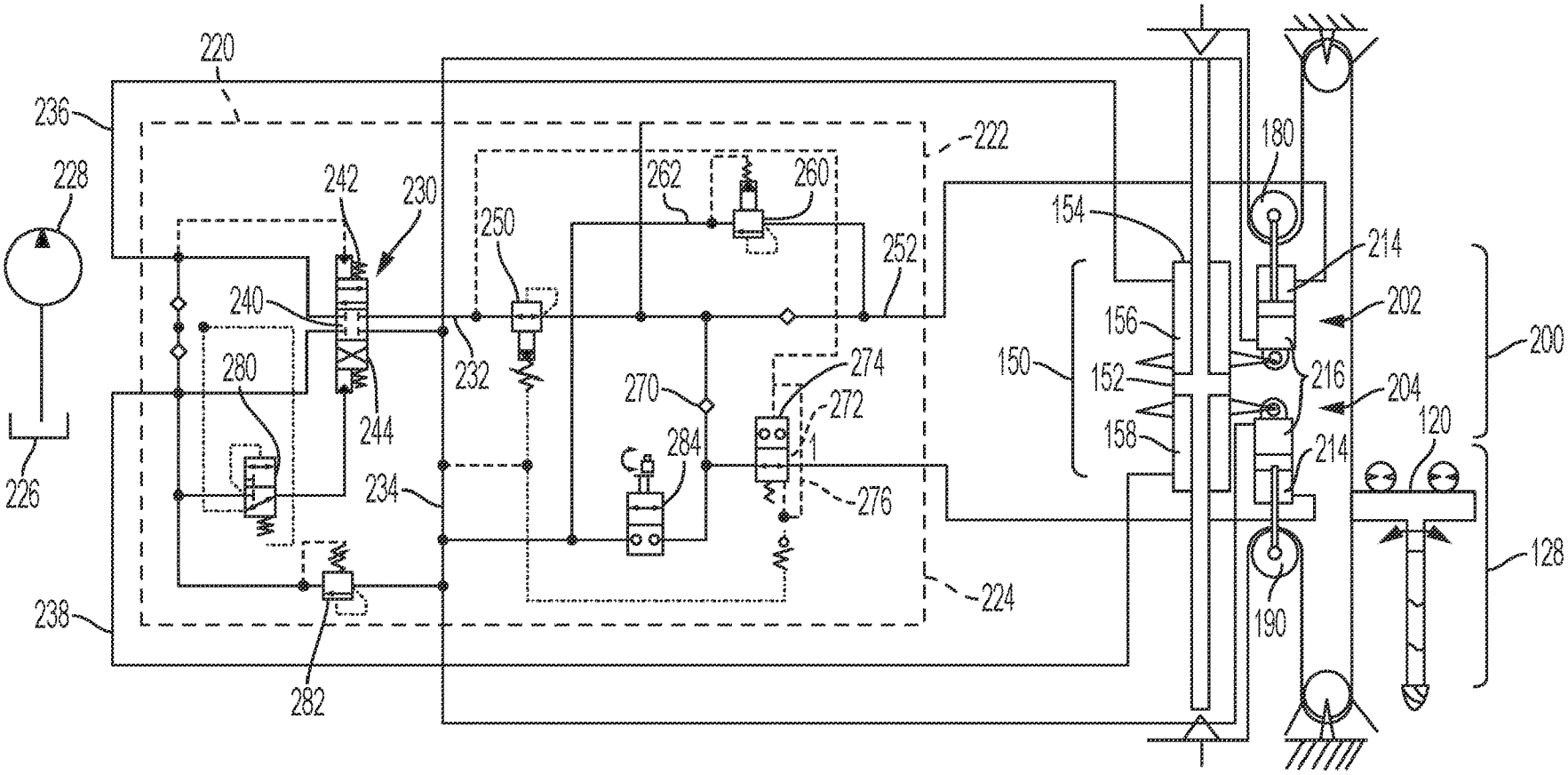
FIG. 4 is a schematic illustration of the wire rope feed system operatively associated with another embodiment of the hydraulic tensioning circuit to maintain tension on the hoist and/or pulldown wire ropes of the wire rope feed system.

Referring to FIG. 4, there is illustrated yet another embodiment of the hydraulic tensioning circuit 220 used to selectively regulate hydraulic flow to the hoist tensioning circuit 222, the pulldown tensioning circuit, and the wire rope feed actuator 150 that is operatively associated with the drilling system 120 and rotary head 122. The illustrated embodiment includes additional components to improve the overall functionality of the drilling system 120.

For example, the hydraulic tensioning circuit 120 may include an additional hydraulic logic valve 280 that is in fluid communication with the hydraulic control valve 230 that regulates the direction of hydraulic fluid flow to and from the wire rope feed actuator 150. One of the upper chamber 156 or lower chamber 158 of the wire rope feed actuator 150 may retain pressurized hydraulic fluid therein, due, for example to the weight of the rotary head 122 that is trying to move the feed actuator piston with respect to the feed actuator cylinder 154 and thereby compress the hydraulic fluid therein. Because the wire rope feed actuator 150 is fluidly connected with the hydraulic control valve 230, the fluid pressure in the wire rope feed actuator 150 may tend to cause the hydraulic control valve 230 to shift between the closed center position 240 and the first and/or second positions 242, 244 at unintended times. Providing the hydraulic logic valve 280 that can be operatively associated with the pilot system that actuates the hydraulic control valve 230. The logic control valve 280 may be a 2-position, four-way valve the selectively blocks hydraulic pressure to the pilot mechanism of the hydraulic control preventing unintended shifts.

The hydraulic tensioning circuit 230 may also include a thermal relief valve 282 operatively associated with the hoist and pulldown tensioning actuator 202, 204 of the hydraulic tensioning system 200. Hydraulic fluid may be retained in the rod end chamber 214 and/or piston end chamber 216 of the hoist and pulldown tensioning actuators 202, 204 and may thermally expand and contract due to changes in ambient temperature even if the drilling system 120 is idle or inoperative. The thermal relief valve 282 is fluidly disposed in communication with the tensioning actuator return conduit 234 and can be set to open at an elevated pressure resulting from the thermal expansion of the fluid in the hoist pulldown tensioning actuators 202, 204. The thermal relief valve 282 may discharge hydraulic fluid to the hydraulic reservoir 226 and thereby relieve hydraulic pressure in the hydraulic tensioning actuators.

The hydraulic tensioning circuit 220 may also include a pressure trapping valve 284 fluidly disposed in the tensioning actuator return conduit 234 to selectively trap hydraulic fluid pressure in the pulldown tensioning actuator 204. For example, the pressure trapping valve 284 may be a two-position valve configurable between fluidly opened and fluidly closed positions that is manually opened but can automatically close. The pressure trapping valve 284 can selectively control fluid flow within the tensioning actuator return conduit 234 from the pulldown tensioning actuator 204 to relieve or trap hydraulic pressure therein.

INDUSTRIAL APPLICABILITY

Figure 5:
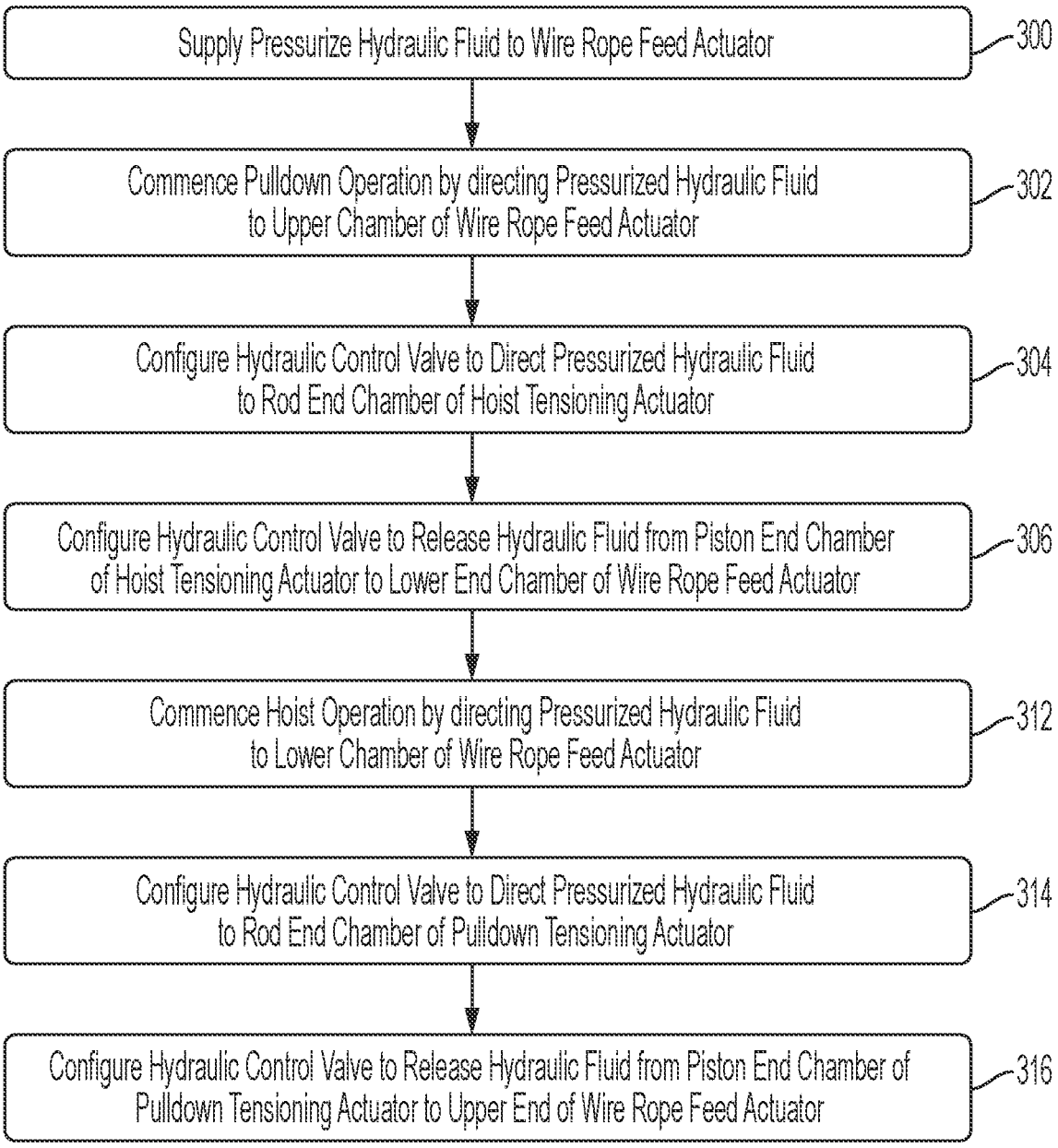
FIG. 5 is a schematic representation of a flow diagram illustrating a possible sequence of actions that may be conducted to selectively direct hydraulic fluid between a hydraulic control valve associated with the hydraulic tensioning circuit and the wire rope feed actuator.

Referring now to FIG. 5, with continued reference to the proceeding figures, there is illustrated the possible actions undertaken by the hydraulic tensioning circuit 220 to maintain the hoist wire rope 184 and/or the pulldown wire rope under tension and reduce the formation of slack therein during pulldown and hoist operations of the wire rope feed system 170. To provide pressurized hydraulic fluid for operation of the wire rope feed system 170 and the hydraulic tensioning circuit 220, in a pressurize fluid supply step 300, the hydraulic pump 228 can pressurize hydraulic fluid from the hydraulic reservoir 226 and direct the pressurized hydraulic fluid to both the wire rope feed actuator 150 and to the hydraulic control valve 230 of the hydraulic tensioning system 220.

In a pulldown operation step 302, the pressurized hydraulic fluid is directed particularly to the upper chamber 156 of the wire rope feed actuator 150 causing the feed actuator cylinder 154 to move vertically upwards with respect to the mast 110 thereby lowering the rotary head 122 toward the work surface 102. To maintain the hoist wire rope 184 under tension during the pulldown operation and reduce slack formation, in a hoist tensioning actuator fluid pressurization step 304, the hydraulic control valve 230 of the hydraulic tensioning circuit 220 can be configured to direct pressurized hydraulic fluid to the rod end chamber 214 of the hoist tensioning actuator 202. This retracts the hydraulic piston rod 218 and the feed actuator hoist pulley 180 connected thereto into the hydraulic cylinder body 210 of the hoist tensioning actuator 202. The hoist wire rope 184 is therefore maintained taut.

To facilitate operation of the hoist tensioning actuator 202, in a hoist tensioning actuator pressure release step 306, the hydraulic control valve 230 may simultaneously established fluid communication between the piston end chamber 216 of the hoist tensioning actuator 202 and the lower chamber 158 of the wire rope feed actuator 150. For example, the hydraulic control valve 230 can fluidly connect the hoist actuator return conduit 256 with the lower chamber conduit 238 connected to the lower chamber 158 of the wire rope feed actuator 150 that is maintaining the lower chamber 158 at a relatively low hydraulic pressure during the pulldown operation. In an further embodiment, both the lower chamber conduit 238 and the hoist actuator return conduit 256 may fluidly communicate with the hydraulic reservoir 226. Hence, the hydraulic pressure in the piston end chamber 216 of the hoist tensioning actuator 202 is released or reduce to facilitate retraction of the hydraulic piston rod 218 and the feed actuator hoist pulley 180 connected thereto and which the hoist wire rope 184 is wrapped about.

In a hoist operation step 312, the pressurized hydraulic fluid is directed to the lower chamber 158 of the wire rope feed actuator 150 causing the feed actuator cylinder 154 to move vertically downwards with respect to the mast 110 and thereby raise the rotary head 122 away from the work surface 102. To maintain the pulldown wire rope 194 under tension during the hoist operation and reduce slack formation therein, in a pulldown tensioning actuator fluid pressurization step 314, the hydraulic control valve 230 can be configured to direct pressurized hydraulic fluid to the rod end chamber 214 of the pulldown tensioning actuator 204. This retracts the hydraulic piston rod 218 and the feed actuator pulldown pulley 190 connected thereto into the hydraulic cylinder body 210 of the pulldown tensioning actuator 204. The pulldown wire rope 194 is therefore maintained taut.

To facilitate operation of the pulldown tensioning actuator 204, in a pulldown tensioning actuator pressure release step 316, the hydraulic control valve 230 may simultaneously established fluid communication between the piston end chamber 216 of the pulldown tensioning actuator 204 and the upper chamber 156 of the wire rope feed actuator 150. For example, the hydraulic control valve 230 can fluidly connect the pulldown actuator return conduit 258 with the upper chamber conduit 236 connected to the upper chamber 156 of the wire rope feed actuator 150 that is maintaining the upper chamber 156 at a relatively low hydraulic pressure during the hoist operation. In a further embodiment, both the upper chamber conduit 236 and the pulldown actuator return conduit 258 may fluidly communicate with the hydraulic reservoir 226. Hence, the hydraulic pressure in the piston end chamber 216 of the pulldown tensioning actuator 204 is released or reduce facilitating retraction of the hydraulic piston rod 218 and the feed actuator pulldown pulley 190 connected thereto and which the pulldown wire rope 194 is wrapped about.

An advantage of the foregoing is that disclosed tensioning hydraulic circuit can reduce or eliminate the slackening of the hoist and/or pulldown wire ropes wire rope feed system by utilizing and manipulating the hydraulic pressure in the hoist and pulldown tensioning actuators to reduce the tension applied, or avoid prolonged application of tension, to the hoist and pulldown wire ropes. Operating the hoist and pulldown wire ropes at lower tension prolongs the operational life of the wire rope feed system and reduces operating cost of the drilling rig. A related advantage is that the hydraulic control valve associated with the hydraulic tensioning circuit can regulate the operation of the tensioning hydraulic circuit in cooperation interaction with the wire rope feed circuit to further regulate the tension stress applied to the hoist and pulldown wire ropes. These and other advantages and features of the disclosure should be apparent from the foregoing description and accompanying drawings.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure and the protection to which applicant is entitled more generally. All language of distinction and disparagement with respect to certain features is intended to indicate a lack of preference for those features, but not to exclude such from the scope of the disclosure entirely unless otherwise indicated.

We claim:

1. A rotary drilling rig comprising:

a rig frame supported on a work surface;

a mast mounted to the rig frame;

a rotary head movably supported along the mast and operatively coupled to and adapted to rotate a drilling string with respect to the work surface;

a wire rope feed actuator movable with respect to the mast;

a wire rope feed system operatively connecting the rotary head and the wire rope feed actuator, the wire rope feed system including:

a hoist wire rope operatively associated with a hoist tensioning actuator and connected at a hoist rope end to the rotary head; and a pulldown wire rope operatively associated with a pulldown tensioning actuator and connected at a pulldown rope end to the rotary head; and a hydraulic tensioning circuit configured to direct hydraulic fluid to the hoist tensioning actuator and to the pulldown tensioning actuator, the hydraulic tensioning circuit including a hydraulic control valve in fluid communication with and configured to selectively direct hydraulic fluid between the hydraulic tensioning circuit and the wire rope feed actuator.

2. The rotary drilling rig of claim 1, wherein the hydraulic tensioning circuit includes a tensioning actuator supply conduit and a tensioning actuator return conduit.

3. The rotary drilling rig of claim 2, wherein the hydraulic control valve includes a plurality of valve positions configured to direct hydraulic fluid to the tensioning actuator supply conduit and to establish fluid communication between the tensioning actuator return conduit and the wire rope feed actuator.

4. The rotary drilling rig of claim 3, wherein the wire rope feed actuator includes an upper chamber fluidly actuating a pulldown operation and a lower chamber fluidly actuating a hoist operation.

5. The rotary drilling rig of claim 4, wherein the hydraulic control valve establishes fluid communication between the lower chamber and the tensioning actuator return conduit and between the upper chamber and the tensioning actuator supply conduit respectively during a pulldown operation.

6. The rotary drilling rig of claim 4, wherein the hydraulic control valve establishes fluid communication between the upper chamber and the tensioning actuator return conduit and between the lower chamber and the tensioning actuator supply conduit respectively during a hoist operation.

7. The rotary drilling rig of claim 2, wherein the hydraulic tensioning circuit includes a pressure reducing valve disposed in fluid communication between the hydraulic control valve and the hoist tensioning actuator and the pulldown tensioning actuator.

8. The rotary drilling rig of claim 2, wherein the hydraulic tensioning circuit includes a pressure relief feature disposed in fluid communication between the hydraulic control valve and the hoist tensioning actuator and configured to relieve hydraulic pressure in the hoist tensioning actuator in excess of a relief pressure threshold.

9. The rotary drilling rig of claim 2, wherein the hydraulic tensioning circuit includes a pressure isolation feature disposed in fluid communication between the hydraulic control valve and the pulldown tensioning actuator configured to isolate hydraulic pressure in the pulldown tensioning actuator.

10. The rotary drilling rig of claim 9, further including a pulldown control valve disposed in fluid communication between the pressure isolation feature and the pulldown tensioning actuator to prevent hydraulic fluid from flowing to the pulldown tensioning actuator during hoisting operations.

11. The rotary drilling rig of claim 2, wherein the hydraulic control valve includes a first valve and a second valve, the first valve disposed in fluid communication with the tensioning actuator supply conduit and the second valve disposed in fluid communication with the tensioning actuator return conduit.

12. The rotary drilling rig of claim 1, wherein the hydraulic control valve includes a closed position that prevents hydraulic fluid from flowing to the hydraulic tensioning circuit.

13. The rotary drilling rig of claim 1, wherein the hoist tensioning actuator and the pulldown tensioning actuator are fixed to the wire rope feed actuator.

14. The rotary drilling rig claim 13, wherein the hoist tensioning actuator is connected with a feed actuator hoist pulley about which the hoist wire rope passes and the pulldown tensioning actuator is connected with a feed actuator pulldown pulley about which the pulldown wire rope passes.

15. The rotary drilling rig of claim 1, wire rope feed actuator includes a feed actuator cylinder;

an upper chamber that fluidly actuates a pulldown operation to move the feed actuator cylinder vertically upwards with respect to the mast; and a lower chamber that fluidly actuates a hoist operation to move the feed actuator cylinder vertically downward with respect to the mast.

16. A method of tensioning a wire rope feed system of a drill rig including a drilling system, the method comprising:

supplying hydraulic fluid under pressure from a hydraulic reservoir to:

a wire rope feed actuator operatively connected with a rotary head of the drilling system via a hoist wire rope and a pulldown wire rope; and a hydraulic control valve operatively associated with a hydraulic tensioning circuit including a hoist tensioning actuator and a pulldown tensioning actuator;

commencing a pulldown operation by directing hydraulic fluid under pressure to an upper chamber of the wire rope feed actuator thereby moving the rotary head toward a work surface via the hoist wire rope and the pulldown wire rope; and configuring the hydraulic control valve of the hydraulic tensioning circuit to:

communicate hydraulic fluid under pressure to a rod end chamber of the hoist tensioning actuator to maintain tension and reduce slack on a hoist rope during the pulldown operation; and communicate hydraulic fluid from a piston end chamber of the hoist tensioning actuator to a lower chamber of the wire rope feed actuator.

17. The method of claim 16, further comprising:

commencing a hoist operation by directing hydraulic fluid under pressure to the lower chamber of the wire rope feed actuator thereby moving the rotary head away from the work surface via the hoist wire rope and the pulldown wire rope; and configuring the hydraulic control valve of the hydraulic tensioning circuit to:

communicate hydraulic fluid under pressure to a rod end chamber of a pulldown tensioning actuator associated with the pulldown wire rope; and communicate hydraulic fluid from a piston end chamber of the pulldown tensioning actuator to the upper chamber of the wire rope feed actuator.

18. The method of claim 17, wherein the hydraulic control valve of the hydraulic tensioning circuit is a unitary three position valve.

19. The method of claim 17, wherein the hydraulic control valve of the hydraulic tensioning circuit includes a first valve fluidly associated with the hoist tensioning actuator and a second valve fluidly associated with the pulldown tensioning actuator.

20. A drilling rig comprising:

a rig frame supported on a work surface;

a mast mounted to the rig frame;

a rotary head movably supported along the mast and operatively coupled to and adapted to rotate a drill string with respect to the work surface;

a wire rope feed actuator movable with respect to the mast;

a wire rope feed system operatively connecting the rotary head and wire rope feed actuator; the wire rope feed system including:

a hoist wire rope fixed at a first end with respect to the mast, connected at a second end to the rotary head, and operatively associated with a hoist tensioning actuator fixed to the wire rope feed actuator; and a pulldown wire rope fixed at a first end with respect to the mast, connected at a second end to the rotary head, and operatively associated with a pulldown tensioning actuator fixed to the wire rope feed actuator.

21. The drilling rig of claim 20, a hydraulic tensioning circuit configured to direct hydraulic fluid to the hoist tensioning actuator and to the pulldown tensioning actuator, the hydraulic tensioning circuit including a hydraulic control valve in fluid communication with and configured to selectively direct hydraulic fluid between the hydraulic tensioning circuit and to the wire rope feed actuator.

* * * * *